United States Patent [19]

Smith et al.

[11] 3,994,084

[45] Nov. 30, 1976

[54] ADJUSTABLE FEEDTHROUGH ROUTER BIT FOR SCRAPERS AND THE LIKE

[75] Inventors: Roger M. Smith; Eugene M. Wilson, both of Joliet, Ill.

[73] Assignee: Caterpillar Tractor Co., Peoria, Ill.

[22] Filed: Apr. 9, 1975

[21] Appl. No.: 566,499

[52] U.S. Cl. ..... 37/141 R; 52/758 F; 172/719; 172/737; 172/777

[51] Int. Cl.[2] ..... E02F 9/28; A01B 35/22

[58] Field of Search ..... 172/719, 702, 703, 704, 172/762, 767, 777, 734, 737, 736; 37/141 R, 141 T, 142 R, 142 A; 403/4; 52/758 F

[56] References Cited

UNITED STATES PATENTS

| | | | |
|---|---|---|---|
| 395,861 | 1/1889 | White | 172/703 |
| 1,208,267 | 12/1916 | Becker | 172/704 |
| 1,381,576 | 6/1921 | McCachen | 172/703 |
| 1,531,643 | 3/1925 | Brewer | 172/762 X |
| 1,770,915 | 7/1930 | Dunelberger et al. | 37/141 R |
| 1,885,741 | 11/1932 | Lutes | 37/142 R |
| 2,310,396 | 2/1943 | Clinkscales, Jr. | 172/737 |
| 2,831,275 | 4/1958 | Kimsey et al. | 37/141 T |
| 2,840,934 | 7/1958 | Hazzard et al. | 172/777 |
| 3,038,267 | 6/1962 | Helton et al. | 172/777 |
| 3,250,051 | 5/1966 | Cheris | 403/4 X |
| 3,643,357 | 2/1972 | Benning et al. | 37/141 R |
| 3,798,805 | 3/1974 | Hancock | 172/767 X |
| 3,839,806 | 10/1974 | Hood et al. | 37/142 R |
| 3,912,020 | 10/1975 | Rockwell | 37/142 R X |

FOREIGN PATENTS OR APPLICATIONS

| | | | |
|---|---|---|---|
| 315,992 | 7/1929 | United Kingdom | 172/719 |
| 568,763 | 4/1945 | United Kingdom | 172/704 |

*Primary Examiner*—Edgar S. Burr
*Assistant Examiner*—Steven A. Bratlie
*Attorney, Agent, or Firm*—Wegner, Stellman, McCord, Wiles & Wood

[57] ABSTRACT

In earthmoving equipment, such as a scraper, an adjustable feedthrough protective bit is mounted on each side wall of the bowl in position to protect the leading edges of the bowl in the vicinity of a cutter blade extending between said side walls. Guide straps or abutments are provided on the walls to hold each bit in fixed position on the bowl and a novel arrangement of apertures and openings are provided in each bit and in the wall of the bowl to facilitate effectively securing the bit to the bowl. The bit configurations may be such as to permit end-for-end reversal of orientation of the bit and to provide for use of the bit on either side of the equipment.

11 Claims, 6 Drawing Figures

ADJUSTABLE FEEDTHROUGH ROUTER BIT FOR SCRAPERS AND THE LIKE

BACKGROUND OF THE INVENTION

1. Field of the Invention

This invention relates to earthmoving equipment and, more particularly, to an adjustable protective bit and means for securing said bit in position to protect the leading edges of said equipment.

2. Description of the Prior Art

On earthmoving equipment, such as scrapers, bulldozers, and the like, the metal forming the leading edges of the bowl or blade, or the like, acts as a cutting edge to cleanly part or fracture the soil in a vertical plane down to or close to the level being stripped from the earth by the horizontal cutter blade. The leading edges of the bowl or blade on either side of the horizontal cutter blade are rapidly worn away if they are not protected by a router bit secured to the bowl or blade. Heretofore, several attempts have been made to provide router bits that are effective to protect the edges of the bowl or blade, but in each case there is some deficiency that resulted in the bit being less than what was desired.

For instance, in U.S. Pat. No. 3,038,267, three bits are secured to the edge of the scoop of a bulldozer blade. Once the bits become worn, they must be discarded. The same problem exists in U.S. Pat. No. 3,032,901 wherein bits are provided on the edge of a bowl in a scraper assembly but, once again, when the bits become worn, they must be discarded. In the Gilbertson U.S. Pat. No. 3,088,232, bits or shoes are provided on the scraper bowl but the bits or shoes must be discarded once they are worn. A great step forward was made in the Kimsey et al. U.S. Pat. No. 2,831,275 wherein a bit is provided that is reversible so that once the bit wears on one side, it can be turned over for use on the other side but once the two halves are used, the bit must be discarded.

SUMMARY OF THE INVENTION

A wear compensating bit is provided for use on a scraper bowl, bulldozer blade, or the like, equipment. The scraper, bulldozer, or the like, has a retaining structure for supporting the bit so that the bit can be advanced through the structure as the bit becomes worn so as to provide wear protection for the leading edges of the bowl, blade or the like. The bit has recessed means for protecting the fastening members from damage by the material being loaded. The design of the bit is such that either end of the bit can be used as a cutting edge. The improved bit design extends the useful life of the bit so that a large percentage of the total material of the bit can be used before the bit is ready to be discarded.

BRIEF DESCRIPTION OF THE DRAWINGS

The details of construction and operation of the invention are more fully described with reference to the accompanying drawings which form a part hereof an in which like reference numerals refer to like parts throughout.

In the drawings.

DESCRIPTION OF THE PREFERRED EMBODIMENT

Figure 1:
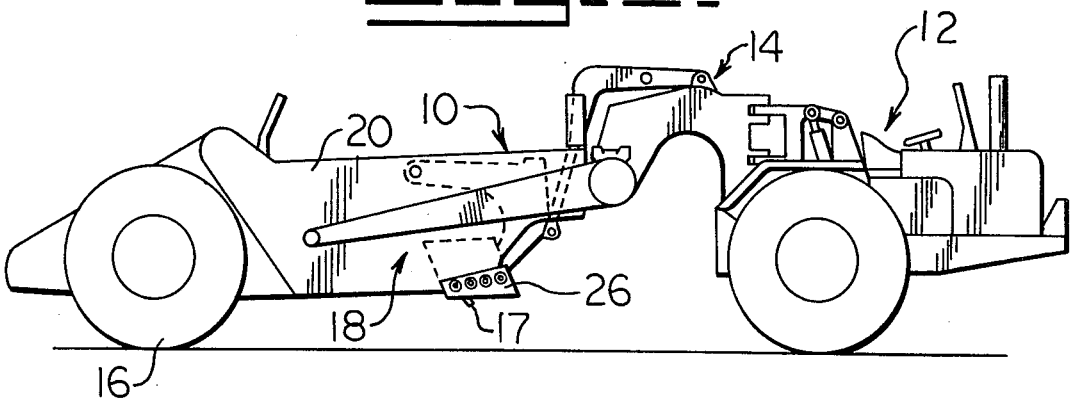
FIG. 1 is a side elevational view of an earthmoving scraper having the improved bit or shoe in position thereon.

In the drawings, and in particular in FIG. 1 thereof, an earthmoving scraper 10 is shown attached to a tractor 12 through a gooseneck arrangement 14. The scraper 10 is drawn behind the tractor and rolls on rear wheels 16. Means are provided for raising and lowering the forward part of the scraper so as to bring a cutter blade 17 into and out of contact with the soil beneath the scraper. The scraper 10 includes a bowl 18 into which the soil that is cut by the cutter 17 is forced by the forward movement of the tractor and scraper. The bowl 18 has parallel spaced apart side walls 20 and 22 on opposite sides thereof between which walls extends a cutter support bar 23 for supporting the cutter blade 17. The leading edges 24 of each wall 20 and 22 on either side of the cutter 17 projects forward and cuts or fractures the soil on either side of the cutter 17 so as to give a clean vertical cut into the furrow or ditch being cut out of the earth by the cutter 17. The leading edges 24 may be the exposed edges of the walls 20, 22 of the bowl 18 or they may be a narrow flange 25 which can be formed by bending over the edge material of the wall or it can be a separate piece welded onto the edge of the wall, in any case the edge of the wall or the flange forms the leading edge 24 of the walls.

Figure 2:
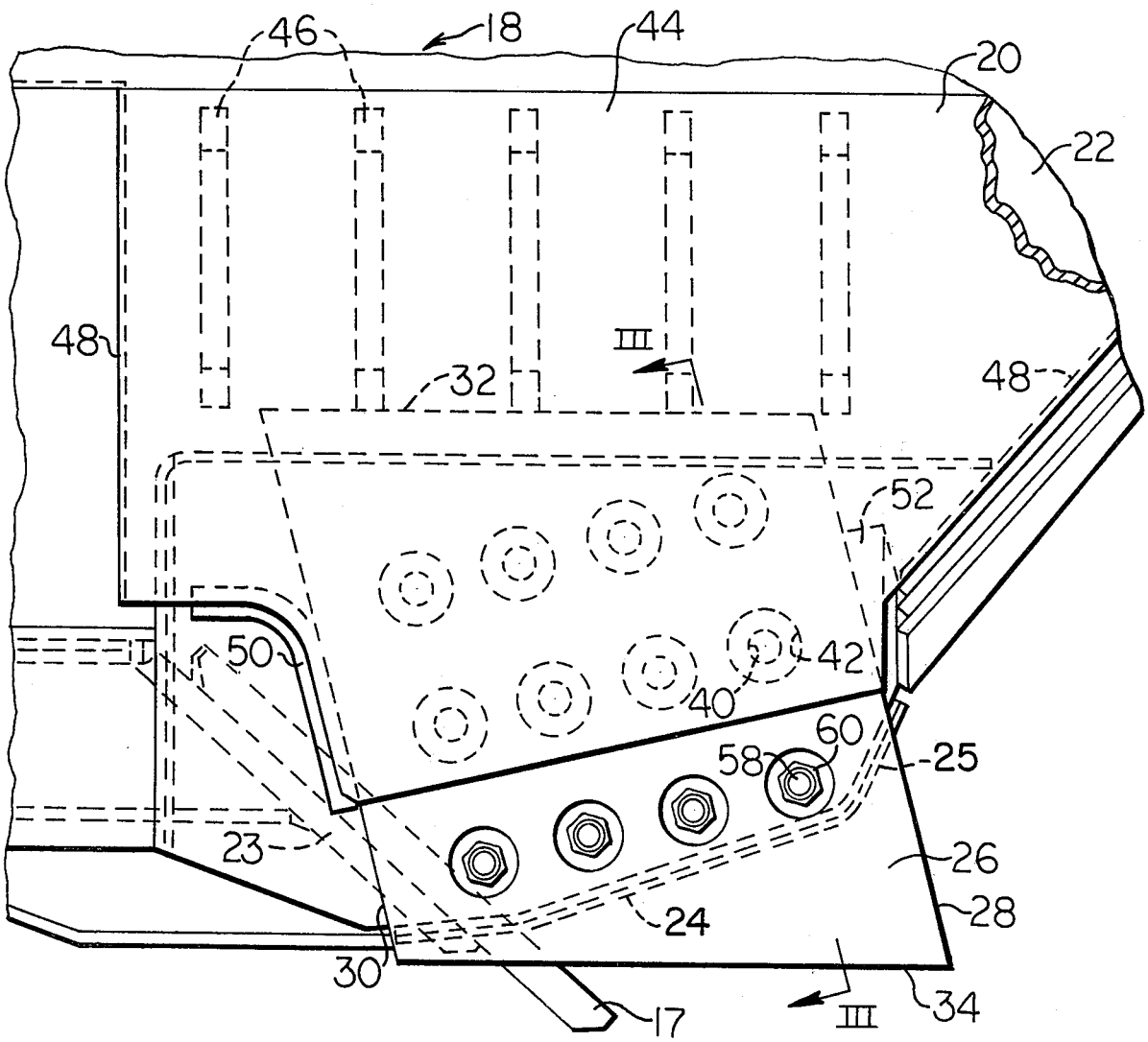
FIG. 2 is an enlarged partial view of that portion of the scraper bowl to which the improved bit or shoe is attached.

As has been described in the several prior art patents referred to above on scrapers, the leading edges 24 of the two sides 20 and 22 are subjected to a great deal of wear as they are drawn through the soil. To protect the leading edges 24, a router bit or shoe 26 is adjustably and replaceably secured to the side walls 20 and 22 of the bowl and which bit projects downwardly and forwardly of the leading edges 24 of the walls so as to protect said leading edges against wear. The router bit or shoe 26, shown in FIG. 2, is a parallelogram in shape and has the front and rear edges 28, 30 lying parallel to each other and has the top and bottom edges 32, 34 lying parallel to each other with said top and bottom edges lying at an angle with respect to the front and rear edges thereof. The bottom edge 34 forms an acute angle with respect to the front edge of said bit. As illustrated, the bit 26 has three parallel rows of apertures 40 extending transversely through the thickness of the bit with each aperture having a countersunk or counterbored recessed portion 42. Each row of apertures 40 is equally spaced from the next adjacent row with each aperture 40 in each row being spaced an equal distance from its adjacent aperture.

A protective skirt or cover plate 44 is held in spaced relation to each wall 20, 22 by means of spacers 46 on said walls and by means of inturned flanges 48 on the forward and rearward edges of said skirt. Welded or otherwise secured to the wall 20 is a supporting strap 50 which is also secured to the rearward and lower portion of the cover plate 44. Spaced horizontally and slightly above said strap 50 and, once again, in close proximity to the lower portion of the cover 44 is a second supporting strap 52 which is welded or otherwise secured to the outer surface of the wall 20 and to the inside of the cover plate 44. The respective supporting straps 50 and 52 are spaced from each other an amount sufficient to just permit the router bit 26 to be slidably received therebetween with the front and rear edges of said bit sliding between contact surfaces of said straps 50, 52.

Figure 3:
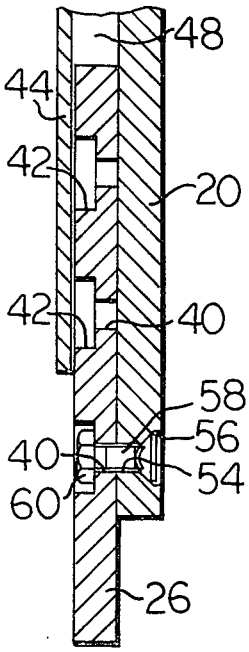
FIG. 3 is a cross-sectional view taken along the lines 3–3 of FIG. 2.

A plurality of openings 54 are formed through the walls 20, 22 in close proximity to the leading edge 24 with each of said openings having a countersunk portion 56 (FIG. 3). The openings 54 are formed on a common axis in a row and are spaced apart an equal amount which spacing coincides with the spacing between adjacent apertures 40 in each row of apertures in the bit 26.

A router bit 26 is threaded between the straps 50, 52 and between the cover plate 44 and the wall 20 until the bottom row of apertures 40 in the bit 26 align with the openings 54 in the wall 20. A plurality of plow bolts 58, in this case four, are passed from the inside of the wall 20 through the countersunk portion 56 and openings 54 and through the aligned apertures 40 in the row of apertures formed along the lower end portion of the router bit 26. Nuts 60 are threaded onto the ends of the bolts 58 and are tightened thereon so as to positively secure the router bit 26 to the lower protion of the side 20 with the front edge 28 and bottom edge 34 of the bit forming the cutting edges and projecting forwardly and downwardly from the leading edge 24 of said wall 20. The nuts 60 are seated in countersunk recesses 42 so as to be protected from the shocks and abrasive effects of the soil.

With the router bits 26 attached to the walls 20, 22, the scraper is ready for use in fracturing the soil in a vertical plane. As the bits 26 are drawn through the soil, the bolts 58 and the straps 50, 52 hold the bits in position on the bowl. The spacing and location of the straps 50, 52 contribute to preventing excessive damage to the bolts. That is, the straps 50, 52 prevent the bit from rotating in the plane of the bit thereby reducing shear on the bolts. After a considerable period of use, the cutting edges 28, 34 on the router bit 26 will have been worn or chipped away and as the wear begins to approach the normal leading edges of the walls 20 and 22, it becomes only necessary to remove the nuts 60 and bolts 58 whereupon the router bit 26 is advanced downwardly in the supporting straps 50 and 52 until the second row of apertures 40 are aligned with the countersunk openings 56 in the lower portion of the walls 20 and 22. The bolts 58 and nuts 60 are reassembled in the aligned apertures and openings whereupon the router bit is, once again, ready for use with the scraper. With the line of bolts and nuts through the second row of apertures in the router bit 26, the router bit is still firmly supported by the straps 50, 52 and by the bolts. After the cutting edges 28, 34 of the router bit are further worn away, the nuts and bolts are removed from the second row of apertures in the router bit and the router bit 26 is advanced until the third row of apertures is aligned with the openings 54 in the side walls 20 and 22. The nuts and bolts are then reinserted and the scraper is, once again, ready for use. There is sufficient overhang beyond the third row of apertures 40 in the router bit so as to provide sufficient support between the straps 50, 52 and the nuts 60 and bolts 58. Since the nuts 60 are protected by being positioned in recesses in the face of the router bit 26, they are not subjected to the misuse and abuse of the soil and, therefore, they are readily ready for removal when it is desired to move the router bit to a new set of openings. In addition, the design of the bit is such that the bit can be rotated 180° in the plane of the bit and reattached to the bowl whereupon a fresh pair of edges 30, 32 are exposed for use.

Figure 4:
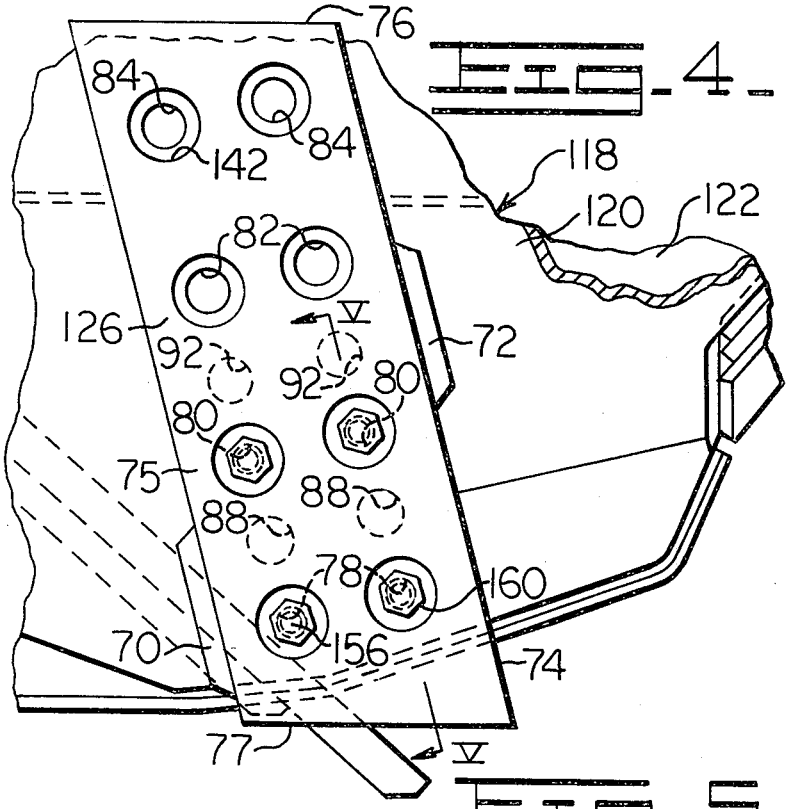
FIG. 4 is a partial view of a scraper bowl showing a modified form of bit or shoe attached thereto.
Figure 5:
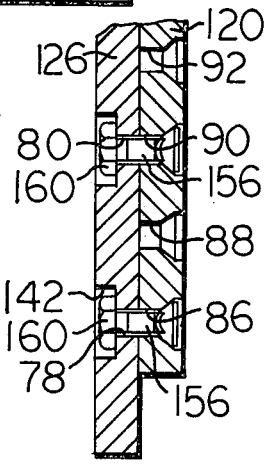
FIG. 5 is a cross-sectional view taken along the lines 5–5 of FIG. 4; and, FIG. 6 is another partial view of a scraper bowl showing still another modified form of bit or shoe attached thereto.

In the modification of the invention, shown in FIGS. 4 and 5, a pair of support straps or guides 70 and 72 are welded or otherwise secured to the outside of the side walls 120 and 122 with the inner surfaces of the guides 70 and 72 lying parallel to each other but offset axially therefrom. A router bit 126 in the shape of a parallelogram is provided with parallel elongate front and rear edges 74, 75 spaced apart a sufficient distance to permit said edges to slide freely between the guides 70 and 72. The top and bottom edges 76, 77 of the bit lie parallel to each other with edge 77 intersecting edge 74 and edge 76 intersecting edge 75 at acute angles. Four pairs of apertures 78, 80, 82, 84 are formed through the router bit 126 with one aperture of each pair of apertures 78, 80, 82, 84 lying along an axis which is parallel to the front and rear edges 74, 75 of the bit 126. Each side wall 120, 122 of the bowl 118 has a plurality of pairs of openings 86, 88, 90, 92 passing therethrough. The openings in each pair of openings in the walls 120, 122 are spaced apart a distance equal to the distance between the apertures in each pair of apertures in the bit. Each pair of apertures in the bit is spaced from an adjacent pair of apertures in the bit by an amount equal to twice the spacing each pair of openings in the wall is spaced from an adjacent pair of openings in said wall. The apertures in the bit have recessed or countersunk portions 142.

In use, two pairs of bolts 156 are passed through the pairs of openings 86, 90 which openings 86, 90 are aligned with the pairs of apertures 78, 80 in the router bit 126 whereupon nuts 160 are threaded onto said bolts for securing the router bit 126 to the side wall 120. The support straps or guides 70 and 72 are positioned in such a way that the heavy loads against the cutting edges 74, 77 of the router bit 126 will provide support for the bit to prevent rotation of the bit 126 in the plane of the bit to reduce adverse loads on the bolts.

After the cutting edges 74, 77 have worn or eroded away considerably, the nuts 160 will be removed from the bolts 156 and the router bit 126 will be advanced one opening in the wall 120 so that the pairs of apertures 80, 82 will now align with the pairs of openings 88, 92 so that bolts 156 can be passed through the openings 88, 92 in the wall 120 and into the apertures 80, 82 respectively, in the router bit 126. Nuts 160 are then threaded onto the bolts and the router bit is again ready for use. After the cutting edges 74, 77 have, once again, worn away, the nuts and bolts are removed and the router bit is advanced one opening so that now the apertures 80, 82 in the router bit will be aligned with the original openings 86, 90 in the wall 120 so that upon reinserting the bolts and nuts, the router bit is again ready for use. The advantage to this construction, as shown in FIGS. 4 and 5, is that the router bit is only advanced a half of a spacing each time, thereby cutting down weakening the router bit 126 by having less number of apertures therethrough while still providing the degree of adjustment of the cutting edge desired.

Once again, the router bit 126 is designed in such a way that it can be rotated 180° in the plane of the bit whereupon the top edge 76 now becomes the cutting edge and the fastening means described above will be applicable in securing the router bit to the bowl of the scraper.

Figure 6:
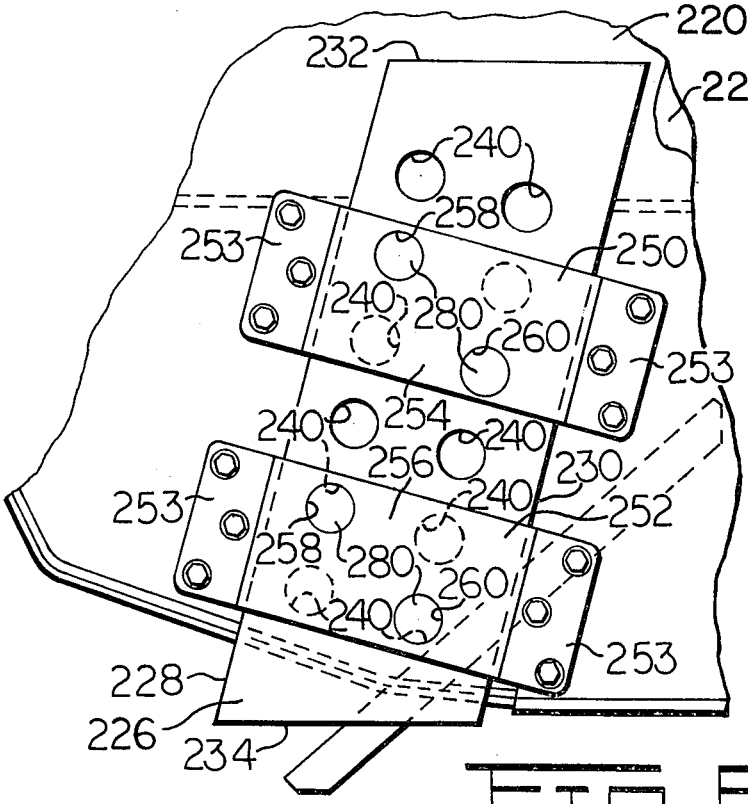

The modification shown in FIG. 6 provides for a pair of shaped supporting straps 250 and 252 which are secured to the side walls 220 and 222, respectively, of the bowl. Each supporting strap 250 and 252 has mounting portions 253 bolted or welded to the outside surface of the walls 220 or 222 and has midportions 254, 256 which are offset from the plane of said mounting portions 253 so that a router bit 226 can be slid or advanced therethrough. The front and rear edges 228, 230 of the router bit 226 are parallel to each other and slide within the offset midportions 254, 256 of the straps 250 and 252 so as to provide not only side-by-side support, but also lateral support to the router bit 226. The bit has top and bottom edges 232, 234 angularly disposed to the front and rear edges. The bottom edge 234 and the lower part of the front edge 228 serve as cutting edges. Each strap 250 and 252 has two openings 258 and 260 formed therethrough and through the walls 220, 222. The openings 258, 260 are located on an axis extending diagonally across each midportion 254, 256. The openings 258 in the straps 250, 252 lie on an axis which is parallel to an axis through the openings 260. The router bit 226 has a plurality of pairs of apertures 240 formed therethrough, one aperture of each pair lying on an axis which axis is parallel to an axis through the other aperture of each pair. The spacing between the axes of the openings 258, 260 is equal to the spacing between the parallel axes of the apertures 240. Bolts may be passed through the openings 258, 260 in walls 220 and 222, through the apertures 240 in the router bit 226 and through the openings 258 and 260 in the straps 250, 252 and bolted thereto, or flush pins 280 may be driven through the aligned openings and apertures, once again, for securing the router bit to the bowl and to the strap.

The flush pins 280 have enlarged end portions and a reduced center portion with a spring element in the reduced center portion which, when the pin is driven into position, will expand and frictionally hold the pin relative to the element in which it is driven. In the present case, with the pins driven through the openings 258, 260 in the wall 220, through the apertures 240 in the router bit 226 and through the openings 258, 260 in the straps 250, 252, the spring element will frictionally seat in the aperture 240 in the router bit with the end portions of the pin in the openings 258 or 260 in the wall 220 and in the openings 258 or 260 in the strap for locking the router bit relative to the wall 220 of the bowl. In each strap, the two pins are diagonally spaced relative to each other so as to provide better support for the cutting edges 234, 228 of the router bit. The pair of spaced apart supporting straps 250 and 252 also provide torsional and lateral support for the router bit thereby, in combination with the pins or bolts, prevents the router bit from moving relative to the wall 220.

In use, after the cutting edges 234, 228 wear away, the flush pins 280 are driven from the openings and apertures and the router bit is advanced one aperture in the lines of apertures through the router bit. Flush pins are then driven through the aligned openings and apertures for securing the router bit relative to the wall 220 with the newly extended cutting edges 234, 228 protecting the leading edge of the bowl.

The router bit of FIG. 6, can be used on either side of the scraper or it can be removed, rotated 180° in the plane of the bit and reinserted with the top edge 232 and rear edge 230 now becoming the cutting edges and projecting toward the front of the bowl ready for contact with the soil as the bowl is drawn forward relative to the earth.

By way of summary, several modified forms of router bits are shown and described wherein by different combinations of aligned openings and apertures between the side walls and the router bit, it is possible to adjustably advance the router bit, relative to the leading edge of the bowl to protect said leading edge against wear. Bolts or pins are used to secure the router bit to the wall and support or guide straps are positioned on the wall in such a way that the router bit is not free to rotate relative to the wall of the bowl. The support or guide straps guide the router bit relative to the cutter blade so as to position the cutting edge of the bit in proper position to protect the leading edge of the bowl. The combinations of openings and apertures makes it possible to reduce the number of apertures formed in the router bit thereby adding strength and added wear surface to the router bit which results in increased life for the router bit.

What is claimed is:

1. In an earthmoving structure comprising a vertically disposed wall, a cutter blade extending downwardly and forwardly of said wall, a leading edge of said wall facing fowardly and downwardly in the vicinity of said cutter blade, a router bit attached to said wall and having a cutting edge projecting forwardly of said leading edge, stabilizing means carried by said wall and engaging with said router bit for stabilizing said bit against rotation in a plane parallel to said wall, said router bit having at least two rows of apertures passing therethrough with each row having at least two apertures, said wall having at least two rows of openings therein, at least one of said rows of apertures in said bit aligning with at least one row of openings in said wall, said bit being shiftable relative to said stabilizing means for moving said cutting edge downwardly relative to said wall as said cutting edge wears away, the next adjacent row of apertures in the bit aligning with said one row of openings in the wall whereby a predetermined extension of said cutting edge relative to said wall is affected, and fastening means passing through said aligned openings and apertures for securing said bit to said wall.

2. In an earthmoving structure as claimed in claim 1 wherein said apertures in said bit are formed in several parallel rows with at least two apertures in each row, one of said openings in said wall being aligned with one aperture in one row of apertures in said bit and one other of said openings in said wall being aligned with one aperture in an adjacent row of apertures in said bit, said last-named opening in said wall and said last-named aperture in said bit being diagonally spaced with respect to the first aligned opening and aperture, said stabilizing means is a strap member fastened to said wall and bridging said bit, said strap member having openings aligning with said aligned apertures in said bit and openings in said wall and said fastening means passing through said aligned openings and apertures for securing said bit to said strap member and to said wall.

3. In an earthmoving structure comprising a vertically disposed wall, a cutter blade extending downwardly and forwardly of said wall, a leading edge of said wall facing forwardly and downwardly in the vicinity of said cutter blade, a router bit attached to said wall and having a cutting edge projecting forwardly of said leading edge, stabilizing means carried by said wall and engaging with said router bit for stabilizing said bit against rotation in a plane parallel to said wall, at least two rows of apertures passing through said router bit, with each row having a pair of apertures, plural rows of openings passing through said wall with each row having two openings, each row of openings being spaced from an adjacent row by a predetermined distance, at least one of said pairs of apertures in said bit aligning with one row of said openings in said wall, the pairs of apertures in the bit are formed in rows with each row of apertures being spaced from an adjacent row of apertures by a distance twice as great as the distance between the adjacent rows of openings, said bit being shiftable relative to said stabilizing means for moving said cutting edge downwardly relative to said wall as said cutting edge wears away, the next adjacent row of apertures in the bit aligning with the next adjacent row of openings in the wall whereby a predetermined extension of said cutting edge relative to said wall is affected, and fastening means passing through said aligned openings and apertures for securing said bit to said wall.

4. In an earthmoving structure as claimed in claim 3 wherein said stabilizing means is a pair of spaced apart straps on said wall engaging front and rear edge portions of said bit in offset relationship.

5. In an earthmoving structure comprising a vertically disposed wall, a cutter blade extending downwardly and forwardly of said wall, a leading edge of said wall facing forwardly and downwardly in the vicinity of said cutter blade, a router bit attached to said wall and having a cutting edge projecting forwardly of said leading edge, stabilizing means carried by said wall and engaging with said router bit for stabilizing said bit against rotation in a plane parallel to said wall, said stabilizing means comprising a pair of strap members fastened to said wall and bridging over said bit, said bit having several parallel rows of apertures with at least two apertures in each row, said wall having at least two openings, one of said openings in said wall being aligned with one aperture in one row of apertures in said bit and one other of said openings in said wall being aligned with one aperture in an adjacent row of apertures in said bit, said last-named opening in said wall and said last-named aperture in said bit being diagonally spaced with respect to the first aligned opening and aperture, each of said strap members having openings aligning with said aligned apertures in said bit and openings in said wall, said bit being shiftable relative to said stabilizing means for moving said cutting edge downwardly relative to said wall as said cutting edge wears away, the next adjacent pair of apertures in the bit aligning with the at least two openings in the wall whereby a predetermined extension of said cutting edge relative to said wall is affected, and fastening means passing through said aligned openings and apertures for securing said bit to said stabilizing means and to said wall.

6. In an earthmoving scraper, a bowl having a pair of spaced apart walls, a cutter blade extending between said walls and projecting downwardly and forwardly of said walls, a leading edge on each of said walls facing forwardly and downwardly in the vicinity of said cutter blade, a router bit attached to each of said walls and having a vertical cutting edge projecting forwardly of said leading edge, stabilizing means carried by each of said walls and engaging with said router bit for preventing rotation of said bit relative to said wall, each of said router bits having at least two adjacent rows of apertures passing therethrough, each of said walls having at least two rows of openings with one row of openings being spaced from an adjacent row of openings by a predetermined amount, at least one row of apertures in each of said bits aligning with said one row of openings in each of said walls, each row of apertures in each of said bits is spaced from the next adjacent row of apertures by an amount twice as large as the predetermined amount of spacing between said rows of openings, and fastening means passing through said aligned openings and apertures for securing said bit to said wall, each said bit may be advanced downwardly as said cutting edge wears away by aligning an adjacent row of apertures in said bit with at least one row of openings in the adjacent wall.

7. In an earthmoving structure as claimed in claim 6 wherein said stabilizing means is a pair of spaced apart straps on said wall engaging front and rear edge portions of said bit in offset relationship.

8. In an earthmoving scraper, a bowl having a pair of spaced apart walls, a cutter blade extending between said walls and projecting downwardly and forwardly of said walls, a leading edge on each of said walls facing forwardly and downwardly in the vicinity of said cutter blade, a router bit attached to each of said walls and having a vertical cutting edge projecting forwardly of said leading edge, stabilizing means carried by each of said walls and engaging with said router bit for preventing rotation of said bit relative to said wall, each of said router bits having at least two adjacent rows of apertures passing therethrough with each row having four apertures, each of said walls having at least one row of openings therein with each row having four openings, at least one row of apertures in each of said bits aligning with said one row of openings in each of said walls, and fastening means passing through said aligned openings and apertures for securing said bit to said wall, each said bit may be advanced downwardly as said cutting edge wears away by aligning an adjacent row of apertures in said bit with at least one row of openings in the adjacent wall.

9. In a scraper as claimed in claim 8 wherein each bit has three rows of apertures which are successively aligned with the row of openings in said wall as said bit is advanced through said stabilizing means.

10. In a scraper as claimed in claim 8 wherein said stabilizing means is a pair of spaced apart straps on said wall engaging front and rear edge portions of said bit.

11. In a scraper as claimed in claim 10 wherein said stabilizing means includes a cover plate bridging the space between the straps and overlapping said bit.

* * * * *